US007695115B2

(12) United States Patent
Akahane

(10) Patent No.: US 7,695,115 B2
(45) Date of Patent: Apr. 13, 2010

(54) LIQUID EJECTING APPARATUS

(75) Inventor: Fujio Akahane, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 352 days.

(21) Appl. No.: 11/872,848

(22) Filed: Oct. 16, 2007

(65) Prior Publication Data

US 2008/0165224 A1 Jul. 10, 2008

(30) Foreign Application Priority Data

Oct. 18, 2006 (JP) ..... 2006-283519

(51) Int. Cl.
*B41J 2/45* (2006.01)

(52) U.S. Cl. ..... 347/68; 347/43

(58) Field of Classification Search ..... 347/67–72, 347/40, 43

See application file for complete search history.

(56) References Cited

U.S. PATENT DOCUMENTS

| | | | | |
|---|---|---|---|---|
| 7,052,118 | B2 * | 5/2006 | Akahane | 347/68 |
| 7,401,896 | B2 * | 7/2008 | Konno | 347/43 |
| 7,585,062 | B2 * | 9/2009 | Momose | 347/71 |
| 2005/0078144 | A1 | 4/2005 | Yamada et al. | |

FOREIGN PATENT DOCUMENTS

| | | |
|---|---|---|
| EP | 0 666 174 A2 | 8/1995 |
| EP | 0 846 556 A2 | 6/1998 |
| JP | 0752377 | 2/1995 |
| JP | 2005-219229 | 8/2005 |
| JP | 2007-001107 | 1/2007 |
| JP | 2007-001108 | 1/2007 |
| JP | 2007-001109 | 1/2007 |

* cited by examiner

*Primary Examiner*—Lamson D Nguyen
(74) *Attorney, Agent, or Firm*—Workman Nydegger

(57) ABSTRACT

A liquid ejecting apparatus comprising a plurality of liquid ejecting heads, each of the liquid ejecting heads including: a liquid introduction pressure adjusting member which is connected to a liquid passage member communicating with a liquid storing member for storing the liquid, the liquid introduction pressure adjusting member being supplied with a liquid from the liquid passage member and introducing the liquid to a side of a pressure chamber; a nozzle array in which a plurality of nozzle holes are arrayed in a line, the nozzle holes ejecting, as liquid droplets by an operation of a pressure generating unit, the liquid introduced from the liquid introduction pressure adjusting member to the pressure chamber; and a driving board for relaying a driving signal to the pressure generating unit and which has a wire connection portion on a sidewall of the liquid ejection head, the wire connecting portion connecting to a wire member for supplying the driving signal. The liquid introduction pressure adjusting member is disposed on an opposite side to a nozzle hole formation surface. The liquid passage member is arranged along the nozzle array on a surface of a side of the liquid introduction pressure adjusting member opposite the nozzle hole formation surface of the liquid ejecting head. The liquid ejecting heads are arranged such that the nozzle hole formation surfaces are arranged in the same plane and the nozzle arrays are parallel to each other.

5 Claims, 9 Drawing Sheets

LIQUID EJECTING APPARATUS

BACKGROUND

1. Technical Field

The present invention relates to a liquid ejecting apparatus such as an ink jet printer, and particularly to the liquid ejecting apparatus of which a main body mounts liquid storing members and which is capable of supplying liquids stored in the liquid storing members to a liquid ejecting heads by connecting the liquid storing members and the plurality of liquid ejecting heads through liquid passage members.

2. Related Art

An exemplary liquid ejecting apparatus that includes a liquid ejecting head capable of ejecting liquids and allows the liquid ejecting head to eject various liquids includes an image printing apparatus such as an ink jet printer that ejects and lands ink droplets on a paper sheet or the like as an ejection target (print medium) to perform a printing. In addition, recently, the liquid ejecting apparatus is not limited to the image printing apparatus, but applied to various manufacturing apparatus. For example, in a display manufacturing apparatus manufacturing a liquid display, a plasma display, an organic electro luminescence (EL) display, a plane emission display (FED), or the like, the liquid ejecting apparatus is used to eject various materials of liquid forms such as a color material or an electrode on a pixel formation area, an electrode formation area, or the like.

Like a business printer or the like performing a printing on a large-scale print paper sheet, the liquid ejecting apparatus that uses a relatively large amount of liquids has a configuration (off-carriage type) in which a liquid supply source (an ink cartridge) is arranged in an apparatus main body as a liquid storing member, a relay unit (which is a type of a liquid introduction pressure adjusting member and also serves as a pressure adjusting valve controlling a pressure variation at the time of supplying ink) for introducing ink stored in the liquid supply source to a liquid ejecting head is mounted in the liquid ejecting head, the liquid supply source and the relay unit are connected to a flexible liquid supply tube (liquid passage member) to supply the ink stored in the liquid supply source to the liquid ejecting head through the liquid supply tube (for example, see Patent Document 1). Moreover, in the liquid ejecting head disclosed in Patent Document 1, the relay unit is arranged on a top surface (surface opposite a nozzle opening formation surface) of the liquid ejecting head, the liquid supply tube is arranged on a top surface of the relay unit. In this way, it is possible to restrain an increase in a size of the liquid ejecting head laterally.

Patent Document 1: JP-A-2005-219229 (FIG. 8)

The liquid ejecting head generally includes a driving board (circuit board) mounted with a driving IC or the like for driving pressure generating means (for example, a piezoelectric vibrator, a heater element, or the like). A connector connecting a flexible wiring cable such as a flexible flat cable (FFC) is disposed in the driving board. In addition, an electrical signal such as a driving signal transmitted from a controller of the apparatus main body through the wiring cable connected to the connector is transmitted to the circuit board.

Since the liquid ejecting head disclosed in Patent Document 1 is designed to reduce a size, the liquid ejecting head has a configuration in which both connectors for connecting the liquid supply tube and the FFC are arranged on the top surface (top surface of the liquid introduction pressure adjusting member) of the relay unit mounted in the liquid ejecting head. In this way, when a plurality of liquid ejecting heads are arranged in a zigzag shape in a connection member to be used in the same way as a line head, numerous liquid supply tubes and FFCs are arranged on the top surfaces of the relay units of the liquid ejecting heads. Accordingly, it is difficult to detach and attach the liquid supply tubes and the FFCs, and thus a problem may arise in that assembly or maintenance is inconvenient.

In order to solve such a problem, it is conceivable that the connectors for connecting the FFCs on sidewalls of the liquid ejecting heads are arranged. However, when the plurality of the liquid ejecting heads 70 are arranged in the zigzag shape so that nozzle arrays 71 become parallel, as shown in FIG. 9, a direction of the liquid ejecting heads 70 can be also uniform. At this time, since the FFCs 72 of the liquid ejecting heads 70 arranged in one row are arranged on a sidewall 73 between rows of the FFCs 72, it is difficult to shorten a distance between the rows of the liquid ejecting head 70 and a problem may arise in that a size of the apparatus increases. Accordingly, in order to solve the problem, as shown in FIG. 10, the liquid ejecting heads 70 (70') can be closely arranged by reversing the liquid ejecting heads 70' in one row by 180°, that is, by opposing sidewalls 74 on which the connectors of the liquid ejecting heads 70 (70') are not arranged. In this case, however, the driving signal supplied to the liquid ejecting heads 70' in the reversed side cannot help being reset to match the reverse direction. Accordingly, the liquid ejecting apparatus may not be used in general, and thus it may be not easy to realize the liquid ejecting apparatus.

SUMMARY

An advantage of some aspects of the invention is to provide a liquid ejecting apparatus designed to reduce an overall size thereof by arranging a wire connection portion of a liquid ejecting head without a change in a control of a driving signal. The advantage can be attained by at least one of the following aspects:

According to an aspect of the invention, there is provided a liquid ejecting apparatus comprising a plurality of liquid ejecting heads, each of the liquid ejecting heads including: a liquid introduction pressure adjusting member which is connected to a liquid passage member communicating with a liquid storing member for storing the liquid, the liquid introduction pressure adjusting member being supplied with a liquid from the liquid passage member and introducing the liquid to a side of a pressure chamber; a nozzle array in which a plurality of nozzle holes are arrayed in a line, the nozzle holes ejecting, as liquid droplets by an operation of a pressure generating unit, the liquid introduced from the liquid introduction pressure adjusting member to the pressure chamber; and a driving board for relaying a driving signal to the pressure generating unit and which has a wire connection portion on a sidewall of the liquid ejection head, the wire connecting portion connecting to a wire member for supplying the driving signal, wherein the liquid introduction pressure adjusting member is disposed on an opposite side to a nozzle hole formation surface, wherein the liquid passage member is arranged along the nozzle array on a surface of a side of the liquid introduction pressure adjusting member opposite the nozzle hole formation surface of the liquid ejecting head, and wherein the liquid ejecting heads are arranged such that the nozzle hole formation surfaces are arranged in the same plane and the nozzle arrays are parallel to each other.

According to the above-described configuration, the nozzle hole formation surfaces are in the same plane and the nozzle arrays are parallel to each other, the liquid passage member is disposed on the opposite side to the nozzle hole formation surface of the liquid ejecting heads along the nozzle arrays, the liquid introduction pressure adjusting member is connected to the liquid passage member, the wire connection portions of the driving boards are arranged on the sidewalls of the liquid ejecting heads and the wire members for supplying the driving signal are connected to the wire connection portions. Accordingly, since a complexity can be solved by arranging the liquid passage member and the wire member so as to be divided to the top surface and the sidewalls of the liquid ejecting heads, it is easy to attach and detach the liquid passage members and the wire members. As a result, it is possible to improve assembly and maintenance of the liquid ejecting apparatus. Moreover, since the wire members of the liquid ejecting head are not arranged between the opposed liquid ejecting heads, but arranged on the sides of the outside of the liquid ejecting heads, the rows of the liquid ejecting heads can be arranged closely. Accordingly, since the nozzle arrays can be arranged closely, alignment of the nozzle arrays can be easily adjusted, and thus a large-scale apparatus for adjusting the alignment is not necessary. As a result, it is possible to reduce the size of the overall liquid ejecting apparatus.

In the liquid ejecting apparatus with the above-described configuration, preferably, the wire connection portion is arranged on both sidewalls opposed to each other in the liquid ejecting head, and each of the wire connection portions and the driving board are electrically connected to each other such that the same driving signal is supplied to the driving board even when the wire member is connected to either the wire connection portions.

According to the above-described configuration, the wire connection portion is arranged on both sidewalls opposed to each other in the liquid ejecting head, and each of the wire connection portions and the driving board are electrically connected to each other such that the same driving signal is supplied to the driving board even when the wire member is connected to either the wire connection portions. Accordingly, when the plurality of liquid ejecting heads are arranged in two rows, it is not required to reverse the direction of the liquid ejecting heads in one side row and it is possible to connect the wire members to the wire connection portions on the sidewalls of the outside opposite the sidewalls of the inside in which the liquid ejecting heads are opposed. In this way, it is not required to change the control of the driving signal and it is possible to closely arrange the liquid ejecting heads in the same direction. As a result, it is possible to reduce the size of the liquid ejecting apparatus more easily.

In the liquid ejecting apparatus with the above-described configuration, a plurality of contact points provided in the wire connection portion are arranged in a height direction of the liquid ejecting head.

According to the above-described configuration, a plurality of contact points arranged in parallel in the wire connection portion may be arranged in a height direction of the liquid ejecting head. Accordingly, even when types of the driving signal increase, and thus the number of the contact points of the wire connection portions increases, it is possible to restrain an increase in the size of the liquid ejecting heads laterally. As a result, it is possible to prevent the size of the liquid ejecting apparatus from increasing.

In the liquid ejecting apparatus with the above-described configuration, preferably, the wire member is formed of a flat cable in which a plurality of conductive wires are arranged in a width direction, and the wire member positioned by changing the width direction to a height direction is connected to a lateral side of each of the liquid ejecting heads, and the wire connection portion in which a plurality of contact points are provided is arranged in the sidewall so as to face the lateral side of each of the liquid ejecting heads and a conductive connection portion formed in an end of the wire member is connected to the wire connection portion.

According to the above-described configuration, the wire member is formed of a flat cable in which a plurality of conductive wires are arranged in a width direction, and the wire member positioned by changing the width direction to a height direction is connected to a lateral side of each of the liquid ejecting heads, and the wire connection portion in which a plurality of contact points are provided is arranged in the sidewall so as to face the lateral side of each of the liquid ejecting heads and a conductive connection portion formed in an end of the wire member is connected to the wire connection portion. Accordingly, by equalizing the length direction of the flat cables connected to the wire connection portions so as to overlap flat portions, the wire connection portions can be arranged along the arranged sidewalls. Thus, it is possible to restrain an increase in spaces in which the wire members are arranged. As a result, it is possible to prevent the size of the liquid ejecting apparatus from increasing. Moreover, since the flat cables can be overlapped on the flat portions so as to be neatly provided on the sides of the liquid ejecting heads, the flat cables can be easily attached or detached. As a result, it is possible to further improve the assembly and maintenance.

In the liquid ejecting apparatus with the above-described configuration, preferably, the conductive connection portion of the flat cable is provided only on one surface of the end and a contact point of the wire connection portion is formed only on one inner wall in the width direction of a connection port of the conductive connection portion, the flat cable and the wire connection portion are electrically connected to each other by matching directions of the flat cable and the wire connection portion so that the conductive connection portion and the contact point come in contact with each other, and the wire connection portions to be supplied with the same driving signal are arranged so as to rotate by 180° in a direction of the nozzle hole formation surface on a center portion of the wire connection portions.

According to the above-described configuration, the wire connection portions to be supplied with the same driving signal are arranged so as to rotate by 180° in a direction of the nozzle hole formation surface on a center portion of the wire connection portion. Accordingly, the row of the contact points of the wire connection portions, which relays the same driving signal, on the one-side sidewalls and the row of the contact points of the wire connection portions on the other-side sidewalls are reversed with each other. For this reason, it is not required to twist the flexible cables in order to reverse the direction, but it is possible to attach the flexible cables to the wire connection portions of any side of the sidewalls. As a result, it is possible to prevent the size of the liquid ejecting apparatus from increasing without an increase in the spaces for arranging the flexible cables.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments for carrying out the invention will be described with reference to the drawings. In addition, in the exemplary embodiment described below, the invention is described as various specific examples of the invention, but the scope of the invention is not limited to the aspects of the invention described below if the gist of the invention is not described otherwise. Moreover, in the exemplary embodiment, as one example of a liquid ejecting apparatus, an image printing apparatus will be described. Specifically, four print heads are arranged in a zigzag shape so as to configure a so-called line head and an ink jet printer (hereinafter, referred to as a printer) which has a print range (ejection range) of the substantially same size as a paper width of a print sheet which is an ejection target.

Figure 1:
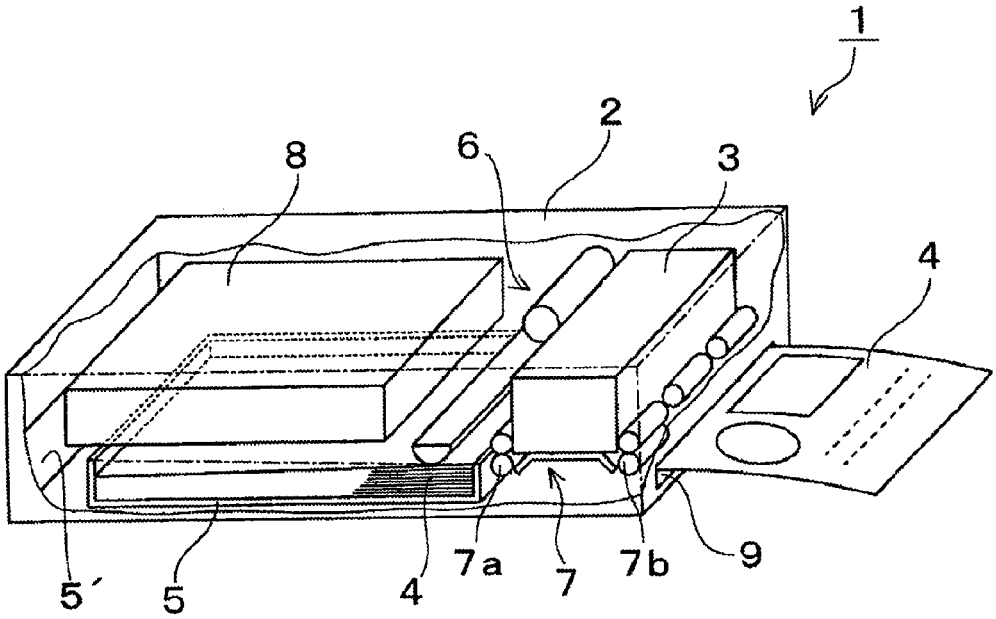
FIG. 1(*a*) is a partial perspective view illustrating an overall configuration of a printer and FIG. 1(*b*) is a top view illustrating a lay-out of the printer.
Figure 1:
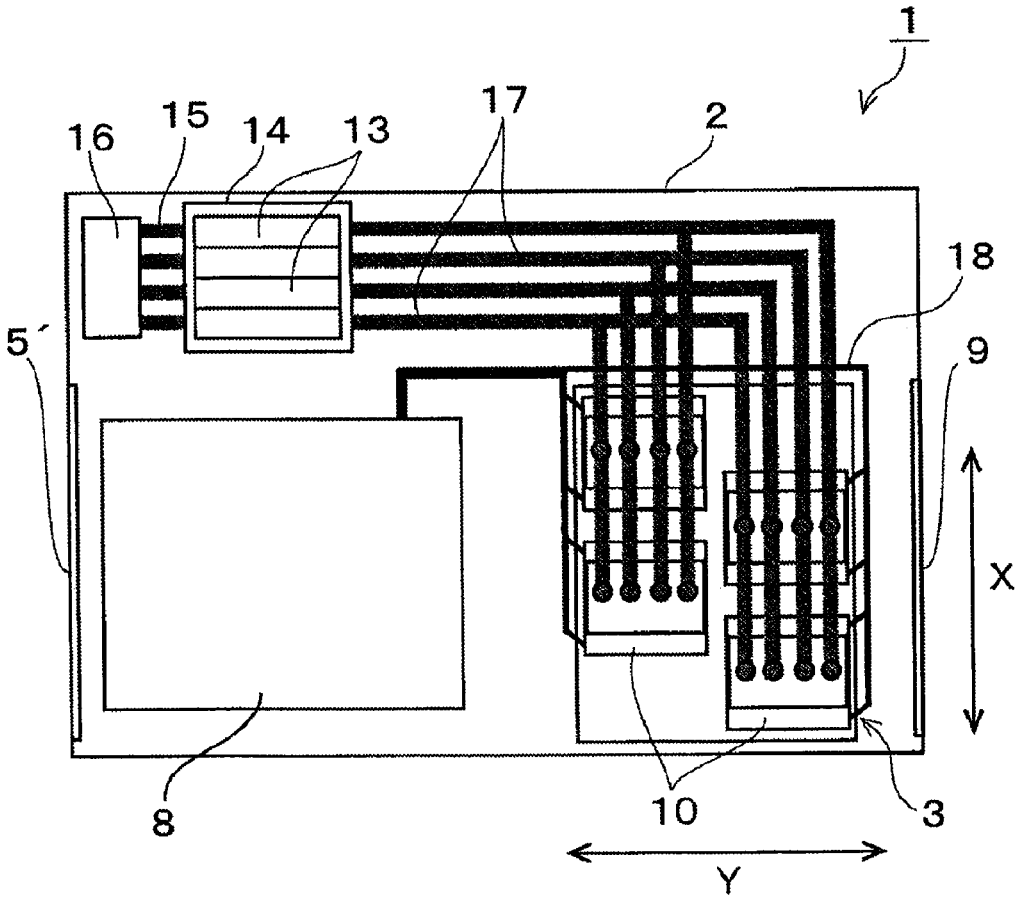

FIG. 1(*a*) is a partial perspective diagram illustrating an overall configuration of a printer according to the invention. FIG. 1(*b*) is a top view illustrating a lay-out of the printer.

As shown in FIG. 1(*a*). a printer 1 according to the exemplary embodiment includes a line head 3, a paper tray 5 receiving a print sheet 4, a feeding portion 6 supplying every print sheet 4 from the paper tray 5 between the line head 3 and a platen, a transport portion 7 transporting the print sheet 4 supplied from the feeding portion 6 between the line head 3 and the platen at a predetermined speed, and a controller 8 performing a driving control of each portions in a chassis 2. In addition, when passing the print sheet 4 between the line head 3 and the platen, the printer 1 is configured to print an image on an entire width of a print area of the print sheet 4 without moving the line head 3.

The chassis 2 is a relatively thin rectangular box made of a plastic material. An ejection portion 9 ejecting the print paper 4 is formed on a sidewall on a downstream side in a transport direction (in a Y direction in FIG. 1(*b*)) of the print sheet 4. A tray slot 5' for attaching or detaching the paper tray 5 is formed on a sidewall opposite the above-described sidewall.

The transport 7 includes an upstream-side paper transfer roller 7*a* transferring the print sheet 4 supplied from the feeding portion 6 between the line head 3 and the platen, a paper transfer guide configured as a supply passage at the time of transporting the print sheet 4, a downstream-side paper transfer roller 7*b* transferring the print sheet 4 passing between the line head 3 and the platen to the ejection port 9, and a paper transfer motor (not shown) driving both the paper transfer rollers 7*a* and 7*b*. In addition, the transport 7 allows the print sheet 4 to be transported from the ejection port 9.

The line head 3 ejects ink droplets of four colors of, for example, cyan, magenta, yellow, and black (CMYK). Nozzle arrays 11 (row of a nozzle hole 11') are positioned in an X direction (direction perpendicular to the Y direction). The line head 3 is arranged on an upper end of the ejection port 9 in the chassis 2 so as to be faced toward the lower platen. In this exemplary embodiment, four print heads 10 are arranged in the zigzag shape so to be linked in a row in a direction of the nozzle array (the x direction in FIG. 1(*b*)). In addition, the four print heads 10 are configured so that gaps between the nozzle arrays 11 of the adjacent print heads 10 are not overlapped when viewed in the Y direction (see FIG. 6(*c*)). Accordingly, the line head 3 according to this exemplary embodiment is configured so that the nozzle arrays 11 have the substantially same size as a width of the print area of the print sheet 4 since the nozzle arrays 11 of all colors of the print heads 10 continue in a width direction of the print sheet 4. In addition, the line head 3 can selectively land the ink droplets from the nozzle holes 11' on the print sheet 4 while the transport portion 7 transports the print sheet 4. Since the line head 3 arranging the print heads 10 in such a manner is not required to move in the width direction of the print sheet 4 at the time of performing a printing like a serial head, a movement mechanism is not required. Accordingly, it is possible to reduce a size or cost of the printer 1. Hereinafter, the print heads 10 will be described in detail.

As shown in FIG. 1(*b*), a cartridge holder 14 mounting so as to attach or detach ink cartridges 13 (corresponding to a type of a liquid storing member according to the invention) is provided in the chassis 2. According to this exemplary embodiment, the total four ink cartridges 13 are mounted in the cartridge holder 14. The ink cartridges 13 are connected to an air pump 16 through air tubes 15 and air of the air pump 16 is supplied to the ink cartridges 13. In addition, the liquid ejecting apparatus is configured so that ink is supplied (sent) to the print heads 10 through ink supply tubes 17 (corresponding to a type of a liquid passage member according to the invention) by reducing the pressure of the ink cartridges 13 by the air.

Each of the ink supply tubes 17 is a flexible longitudinal hollow member and is formed in correspondence with each of the ink cartridge 13 (each color). FFCs (flexible flat cable extending a plurality of conductive wires in the width direction and a type of a wire member according to the invention) 18 for transporting a driving signal or the like from the controller 8 of a main body of the printer 1 to the print heads 10 are wired between the main body of the printer 1 and the print heads 10.

Figure 2:
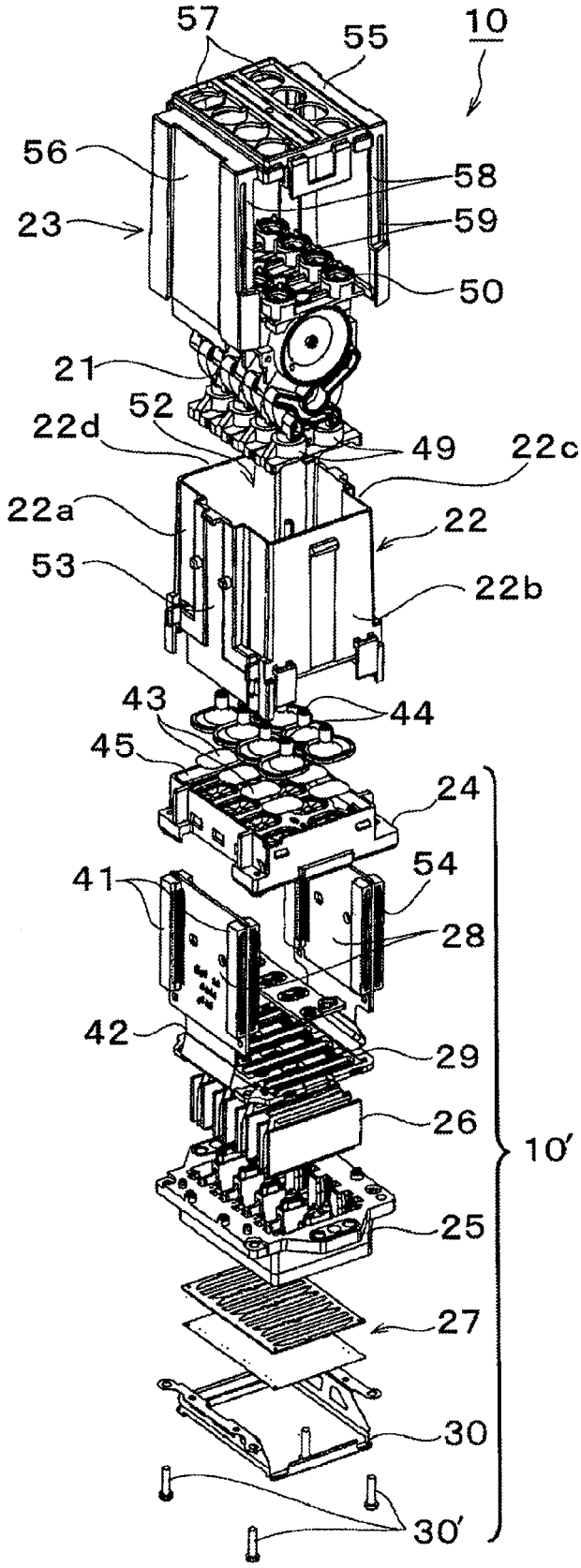
FIG. 2 is an exploded perspective view illustrating each print head.
Figure 3:
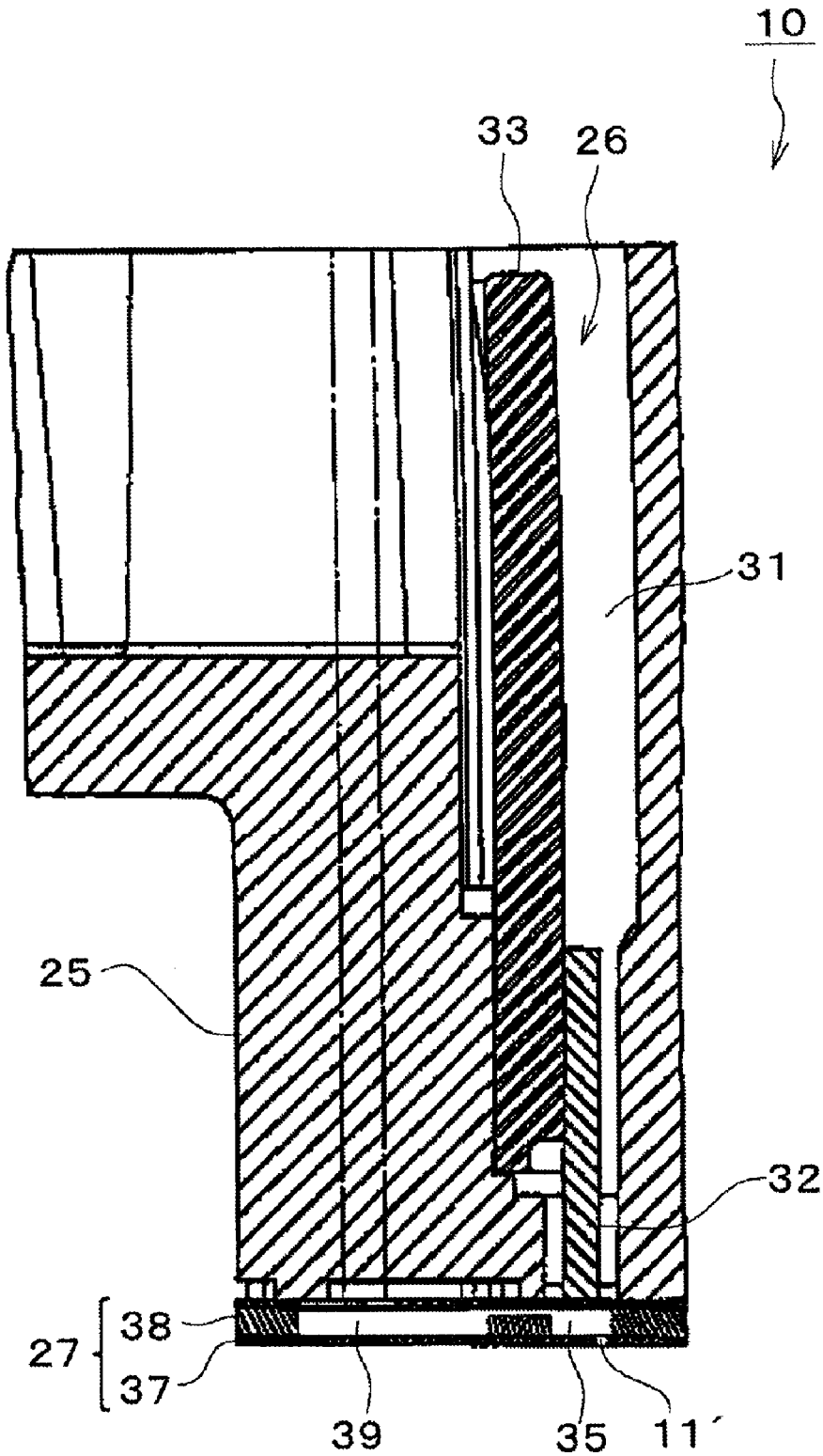
FIG. 3 is a sectional view illustrating major portions of the head main body of each print head.
Figure 4:
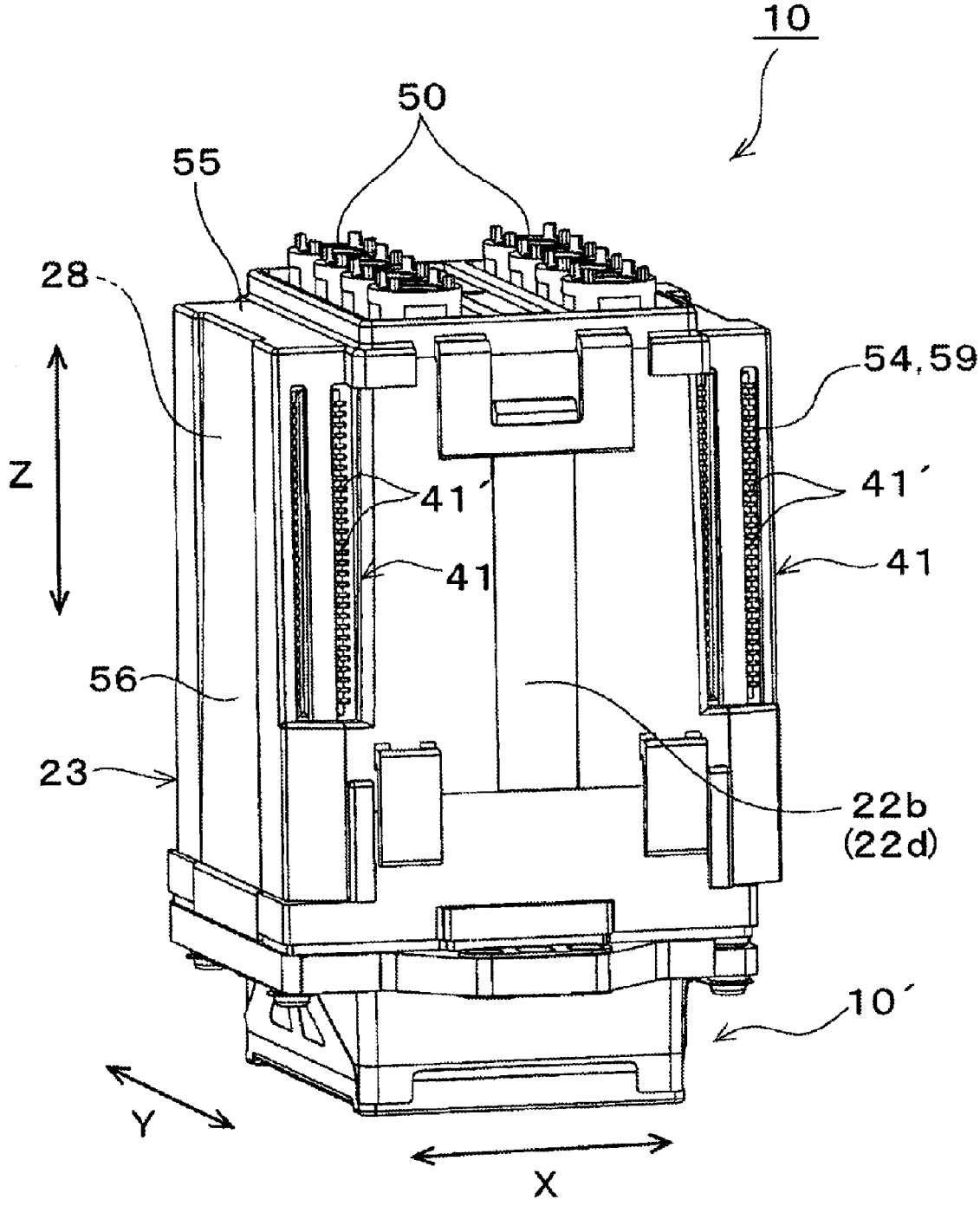
FIG. 4 is a perspective view illustrating each print head.

Next, the print heads 10 constituting the line head 3 will be described. FIG. 2 is an exploded perspective view illustrating each print head. FIG. 3 is a sectional view illustrating major portions of the head main body of each print head. FIG. 4 is a perspective view illustrating each print head.

Each of the print heads 10 mainly includes a head main body 10', ink pressure adjusting units 21 (a type of a liquid introduction pressure adjusting member according to the invention) a first case 22, and a second case 23. The head main body 10' is constituted by an introduction needle unit 24, a head case 25, a vibration unit 26, a passage unit 27, driving boards 28, a relay board 29, a head cover 30, and the like.

The head case 25 is a member with a hollow box shape. As shown in FIG. 3, the passage unit 27 is fixed on the apical surface (bottom surface), the vibration unit 26 is retained in a hollow retention portion 31 formed in the inside, and the relay board 29 and the introduction needle unit 24 are arranged on a base end surface (top surface) opposite the passage unit 27. The vibration unit 26 includes a plurality of piezoelectric vibrators 32 (a type of pressure generating means) arranged in a pectinated shape in lines, a wire member (not shown) for supplying the driving signal to the piezoelectric vibrators 32, a fixation plate 33 for fixing the piezoelectric vibrators 32, and the like. The piezoelectric vibrators 32 are jointed to a flexible surface (vibration plate) partitioning a pressure chamber 35 in the passage unit 27. In addition, the piezoelectric vibrators 32 are driven to be expanded in accordance with the driving signal so as to expand and contract volume of the pressure chamber 35. In this way, by inducing a change in a pressure of the ink in the pressure chamber 35, it is possible to eject the ink droplets from the nozzle holes 11' by control of the change in the pressure.

Figure 6:
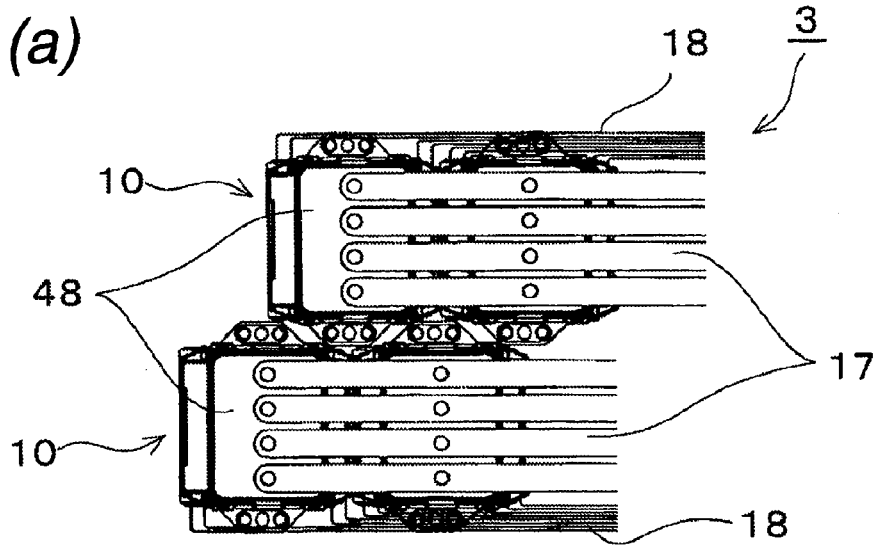
FIG. 6(*a*) is a top view illustrating the line head 3, FIG. 6(*b*) is a side view illustrating the line head 3, and FIG. 6(*c*) is a bottom view illustrating the line head 3.
Figure 6:
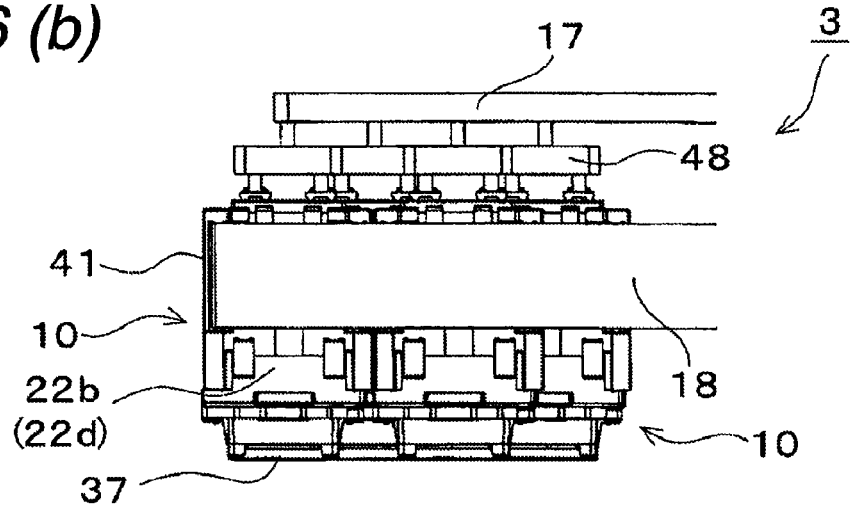
Figure 6:
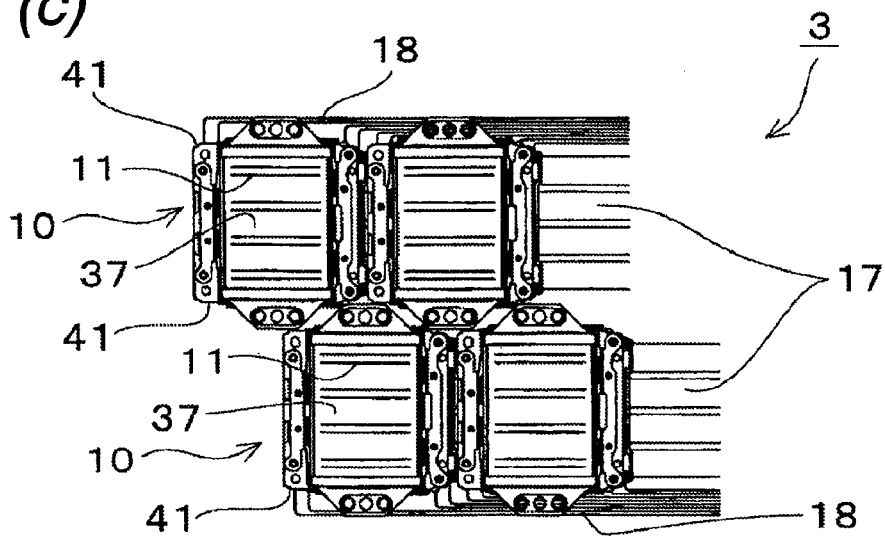

The passage unit 27 is configured in a manner in which a nozzle formation board 37 (see FIG. 6(*c*)) having the nozzle array 11 arranging the nozzle hole 11' in lines and a configuration member such as a passage formation board 38 forming an ink passage are incorporated to be stacked. In addition, the passage unit 27 is a unit member forming a series of the ink passage (liquid passage) from a common ink chamber 39 (common liquid chamber) to the nozzle hole 11' through an ink supply port and the pressure chamber 35. The pressure chamber 35 in the passage unit 27 is formed every nozzle hole 11' and is configured so that the ink is supplied from the ink pressure adjusting units 21 through the common ink chamber 39. The passage unit 27 is joined on the end surface of the head case 25. In addition, the metal head cover 30 is attached by fixation members 30' so as to surround a peripheral portion from the outside of the joined passage unit 27. The head cover 30 protects the passage unit 27 and the head case 25 and prevents troubles such as noise caused by static electricity generated from the print sheet 4 by adjusting the nozzle formation board 37 of the passage unit 27 to ground potential.

The driving boards 28 include connectors 41 (a type of a wire connection portion according to the invention) for connecting the FFCs 18 and are configured so as to receive the driving signal from the controller 8 and supply the driving signal to the piezoelectric vibrators 32 through the FFCs 18. That is, the driving boards 28 relay the driving signal from the controller 8 to the piezoelectric vibrators 32. Each of the print heads 10 according to this exemplary embodiment includes the total 2 pieces of driving boards 18. In addition, since two connectors 41 are mounted on each of both the end portions of the driving board 28, each of the print heads 10 includes the total 8 connectors 41. The driving boards 28 are connected to the relay board 29 through the flexible cable 42 and are attached to a board fixation portion 53 of the first case 22 described below. The relay board 29 is a board that relays a signal path between the driving boards 28 and the piezoelectric vibrators 32 and is arranged on the base end surface (the surface opposite a surface of the nozzle formation board 37)

The introduction needle unit 24 in addition to the relay board 29 is arranged on the base end surface of the head case 25. A plurality of ink introducing needles 44 (liquid introducing needles) are retained in the introduction needle unit 24, which is cast in synthetic resins or the like, in a case where a filter 43 is mounted on the top surface of the introduction needle unit 24. An adjustment unit arrangement portion 45 for arranging the ink pressure adjusting units 21 is provided on the top surface of the introduction needle unit 24, that is, the surface opposite the surface of the nozzle formation board of the head main body 10'. In addition, when the ink pressure adjusting units 21 is mounted in the adjustment unit arrangement portion 45, the ink introducing needles 44 are inserted in the ink pressure adjusting units 21. Connection passages (not shown) in correspondence with the ink introducing needles 44 are formed on the bottom surface of the introduction needle unit 24. The connection passages are configured to supply the ink from the ink introducing needles 44 to the pressure chamber 35.

Figure 5:
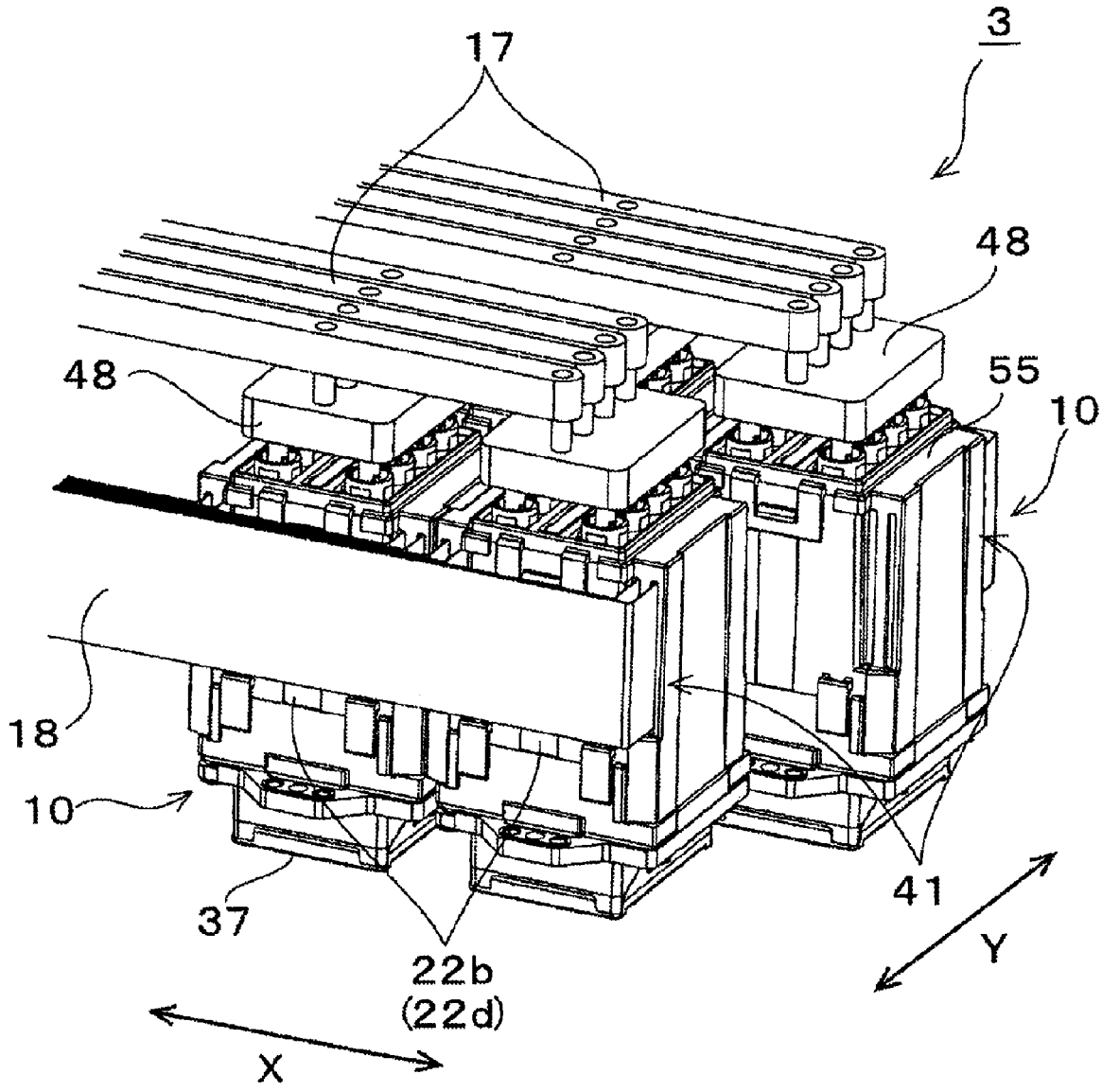
FIG. 5 is a perspective view illustrating a line head.

As shown in FIG. 5, the ink pressure adjusting units 21, which is connected to the ink supply tubes 17 through an attachment 48 connected to the top surface, introduces the ink from the ink supply tubes 17 to the pressure chamber 35 of each of the print heads 10. In addition, as shown in FIG. 12, the total four ink pressure adjusting units 21 are mounted on the adjustment unit arrangement portions 45 of the print heads 10 in correspondence with the ink cartridges 13 (each color) or each ink supply tube 17. An introduction needle insertion portion 49 is provided on the bottom portion of each of the ink pressure adjusting units 21 and when the ink pressure adjusting units 21 are placed on the adjustment unit arrangement portion 45, the ink introducing needle 44 is inserted into the introduction needle insertion portion 49. A passage connection portion 50 connected to the attachment 48 protrudes upward from the top surface of the ink pressure adjusting units 21. In addition, an ink distribution passage (not shown) corresponding to the passage connection portion 50 of each ink pressure adjusting unit 21 is partitioned in the inside of the attachment 48. The ink stored in the ink supply tube 17 is configured to be supplied to each of the ink pressure adjusting units 21 through the ink distribution passage. That is, the ink supply tubes 17 and the ink pressure adjusting units 21 are connected to each other with each attachment 48 interposed.

The ink pressure adjusting units 21 open and close valve in accordance with a change in an inner pressure and has a function of performing a self sealing process for controlling introduction of the ink to the head main body 10' (pressure chamber 35) of each of the print heads 10. That is, at a non-print time (time of consuming the ink) when each of the print heads 10 does not eject the ink droplets, the ink pressure adjusting units 21 close the valve so as not introduce the ink to the head main body 10'. Alternatively, when each of the print heads 10 consumes the ink by ejecting the ink droplets at a print time (ejecting process) and the inner pressure of the ink pressure adjusting units 21 decrease, the ink pressure adjusting units 21 open the valve to introduce the ink to the head main body 10'. Accordingly, the ink pressure adjusting units 21 can reduce the change in the pressure of the ink as small as possible by controlling the ink introduced to the head main body 10' (the pressure chamber 35). As a result, it is possible to stabilize the ejecting process of the ink droplets. That is, the ink pressure adjusting units 21 have a function of adjusting the pressure of the ink introduced to the pressure chamber 35 of each of the print heads 10.

As shown in FIG. 2, the first case 22 is surrounded by four sidewalls of a first sidewall 22*a* to a fourth sidewall 22*d* and is sleeve-shaped member of which the top and bottom are open. A plane shape of the opening of the first case 22 is substantially rectangular and the inner space thereof is a hollow reception portion 52 for receiving the ink pressure adjusting units 21 arranged on the adjustment unit arrangement portion 45. In addition, in each of the first case 22, board fixation portions 53 for fixing the driving boards 28 are each formed on the two sidewalls (the first sidewall 22*a* and the third sidewall 22*c*) opposed with each other. When the driving boards 28 are attached to the board fixation portion 53, as shown in FIG. 4, connection ports 54 of the connectors 41 are arranged on the second sidewall 22*b* and the fourth sidewall 22*d* in an arrangement direction of the ink pressure adjusting units 21, that is, in the Y direction.

As shown in FIG. 2, the second case 23 is a member of which an end has a substantial door shape or a D shape. The second case 23 is constituted by a base surface 55 covering an upper opening of the hollow reception portion 52 in the first case 22 and sidewalls 56 extending downward (the mounted head main body 10') from edges of both sides in a direction perpendicular to the arrangement direction of the ink pressure adjusting units 21 in the base surface 55. The base surface 55 covers the ink pressure adjusting units 21 exposed from the upper opening of the hollow reception portion 52 of the first case 22. In addition, the sidewalls 56 cover the driving boards 28 fixed on the board fixation portions 53 of the first case 22.

Exposure openings 57 for exposing passage connection portions 50 are arranged to be opened in portions corresponding to the passage connection portions 50 of the ink pressure adjusting units 21 received in the hollow reception portion 52. In this exemplary embodiment, since the two passage connection portions 50 relative to the one ink pressure adjusting unit 21 are provided, total 8 exposure openings 57 are provided in correspondence with the four ink pressure adjusting unit 21.

Connector cover walls 58 are provided in both edges of the sidewalls 56 so as to be bent toward the sidewalls 56 which are opposed with each other. In the connector cover walls 58, through-openings 59 are arranged in portions corresponding to the connection ports 54 of the connectors 41 fixed on the first case 22. In addition, even when the second case 23 are retained in the first case 22, the through-openings 59 is opened so that the FFCs 18 can be connected to the connection ports 54 of the connectors 41. As shown in FIG. 4, when the second case 23 is retained from the outside of the first case 22, the ink pressure adjusting units 21 exposed from the upper openings of the hollow reception portion 52 of the first case 22 and the driving boards 28 fixed on the board fixation portions 53 are covered. In this way, the passage connection portions 50 of the ink pressure adjusting units 21 are exposed from the exposure openings 57 of the base surface 55.

Figure 7:
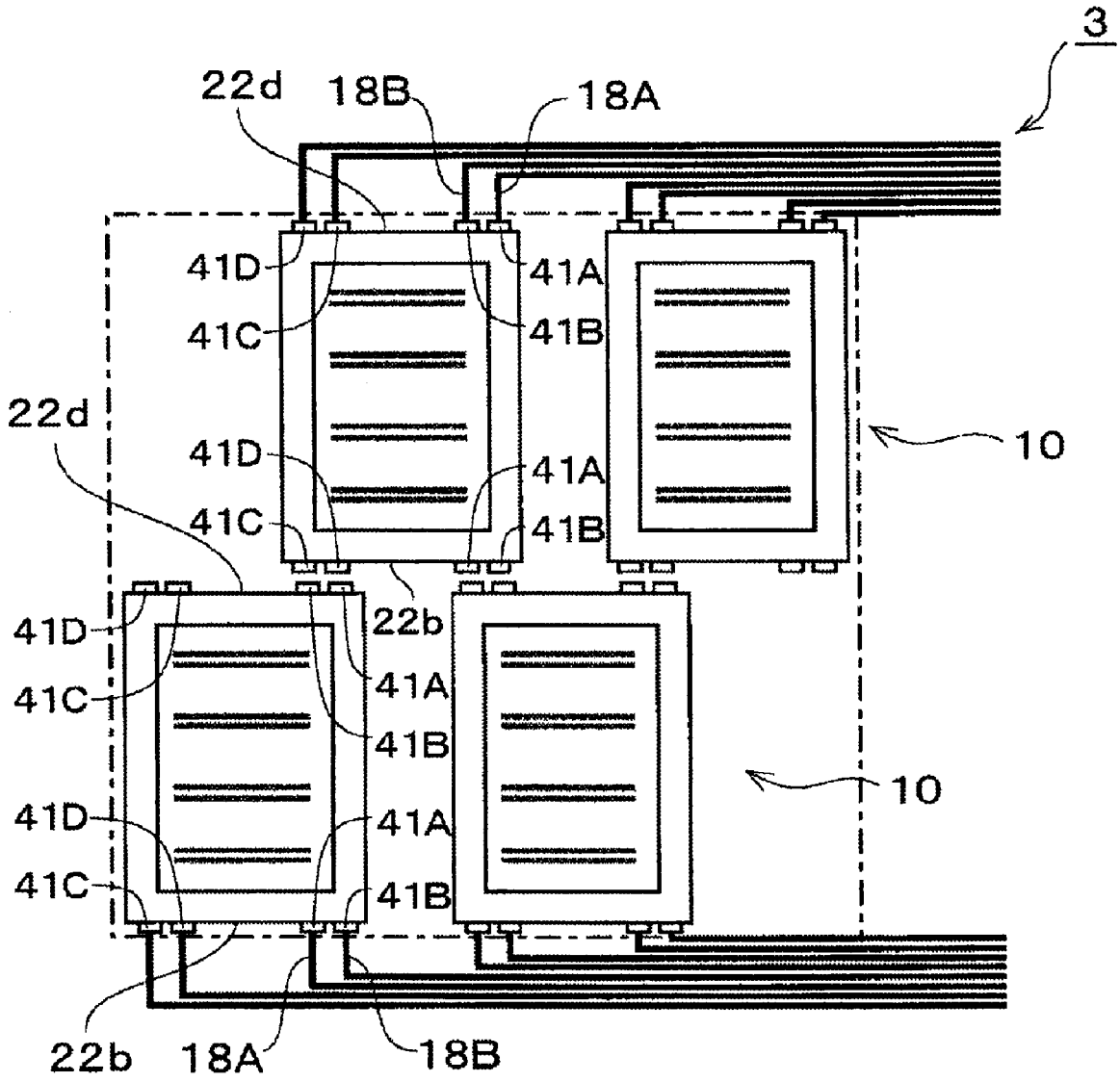
FIG. 7 is a top view illustrating the line head 3 connected to the FFCs when viewed from the bottom side.
Figure 8:
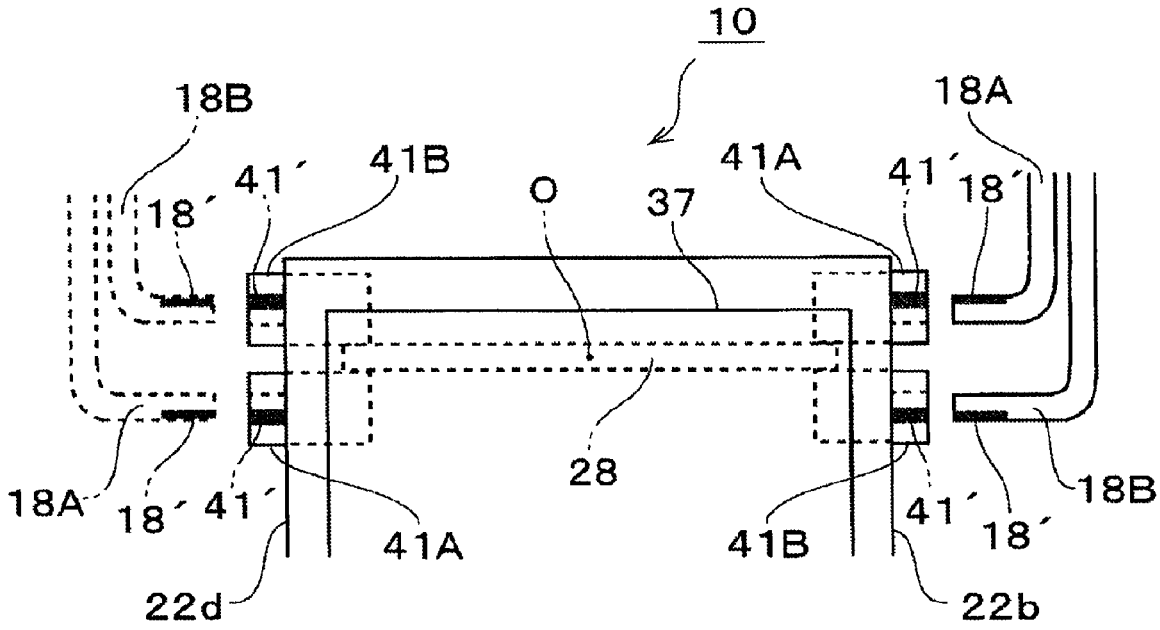
FIG. 8 is a partial enlarged view illustrating the print heads to explain the relationship between the FFCs and the connectors.
Figure 8:
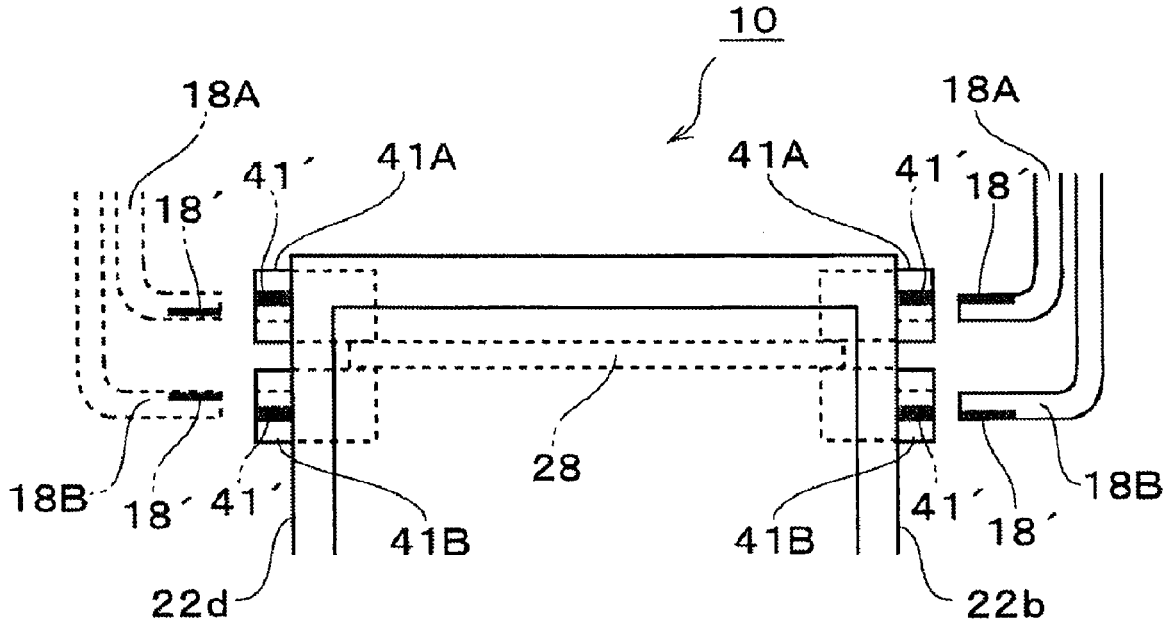
Figure 9:
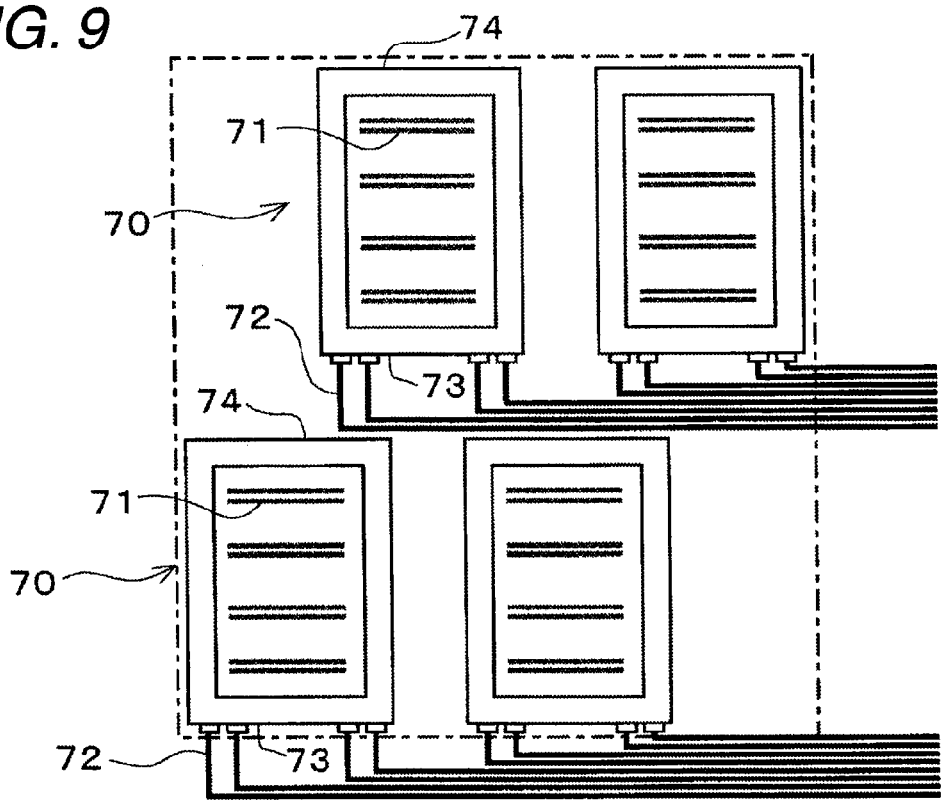
FIG. 9 is a top view showing connection of the FFCs of the line head when viewed from a bottom side.

Next, a case where the ink supply tubes 17 and the FFCs 18 are mounted in the so-called line head 3 in which the plurality of print heads 10 are arranged will be described. FIG. 5 is a perspective view illustrating a line head. FIG. 6 is a diagram illustrating the line head 3 shown in FIG. 5 when viewed in three directions. FIG. 6(*a*) is a top view illustrating the line head 3, FIG. 6(*b*) is a side view illustrating the line head 3, and FIG. 6(*c*) is a bottom view illustrating the line head 3. FIG. 7 is a top view illustrating the line head 3 connected to the FFCs when viewed from the bottom side. FIG. 8 is a partial enlarged view illustrating the print heads to explain the relationship between the FFCs and the connectors.

In the printer 1 according to the exemplary embodiment, as shown in FIGS. 5 and 6, the nozzle formation boards 37 of the four print heads 10 are placed on the same plane. Further, the four print heads 10 are arranged in a zigzag shape in the nozzle array direction (the paper width direction of the print sheet and the X direction) so that the nozzle arrays 11 of the print heads 10 are paralleled with each other. In this way, gaps between the nozzle arrays 11 of the adjacent print heads 10 are not overlapped when viewed in the arrow Y direction. The plurality of ink supply tubes 17 are arranged in the direction of the nozzle array on the top surface (the base surface 55) of the print heads 10, that is, on the top surface of the ink pressure adjusting unit 21 opposite the surface of the nozzle formation board 37. In addition, the passage connection portions 50 of the ink pressure adjusting units 21 are connected to the ink supply tubes 17 through each attachment 48 and the FFCs 18 supplying the driving signal are connected to the connectors 41 of the driving boards 28. That is, the printer 1 according to the exemplary embodiment has a configuration in which the ink supply tubes 17 are arranged on the upper portion (base surface 55) of the four print heads 10 arranged in the zigzag shape and the connectors 41 connecting the FFCs 18 to the side portions (sidewalls 22*b* (22*d*)) are arranged.

According to the above-described configuration, a complexity can be solved by separately arranging the ink supply tubes 17 and the FFCs 18 on the top surface and the sidewalls of the print heads 10. Moreover, even when the line head 3 is configured so as to arrange the plurality of the print heads 10, it is easy to detach and attach the ink supply tubes 17 and the FFCs 18. As a result, it is possible to improve assembly and maintenance. Moreover, even when the line head 3 is configured by arranging the print heads 10 in two rows, the FFCs 18 are not arranged between the print heads 10, but are arranged in side portions of the line head 3 (group of the print heads 10). In this way, since the rows of the print heads 10 are closely arranged, it is possible to reduce the size of the line head 3. Accordingly, an alignment of the nozzle arrays 11 can be easily adjusted, and thus a large-scale alignment apparatus is not required.

Since the ink supply tubes 17 are arranged on the upper portion (the top surface) of the ink pressure adjusting units 21, buoyancy can upward move bubbles staying in ink passages in the print heads 10, and thus it is possible to stay the bubbles in the ink supply tubes 17 which are a little affected by a pressure control of the ink. Moreover, the passage connection portions 50 of the ink pressure adjusting units 21 and the connectors 41 of the driving boards 28 are arranged apart. Accordingly, even though the ink scatters at the time of attaching and detaching the ink supply tubes 17 (attachment 48), it is possible to reduce a short trouble due to the attachment of the ink to the connectors 41.

In the print head 10, even when the connectors 41 relaying the same driving signal are separately arranged on both the sidewalls (the second sidewall 22*b* and the fourth sidewall 22*d*) which are opposed with each other and the FFCs 18 are connected to any of the connectors 41, the connectors 41 and the driving boards 28 are electrically connected so as to supply the same driving signal to the driving boards 28. Specifically, as shown in FIGS. 7 and 8, the connectors 41A to 41D are arranged on the second sidewall 22*b* of the print head 10 and the connectors 41A to 41D are arranged on the fourth sidewall 22*d*. That is, according to the exemplary embodiment, for example, the connectors 41A receiving the same signal are arranged on both the second sidewall 22*b* and the fourth sidewall 22*d* in the print heads 10. Accordingly, even when the FFCs 18A are connected to the connectors 41A of any of the second sidewall 22*b* and the fourth sidewall 22*d*, the same driving signal is supplied to the driving boards 28. The same is applied to other connectors 41B to 41D. In each driving board 28 according to the exemplary embodiment, as shown in FIG. 8, two connectors are formed in each end, and thus the total four connectors 41 are formed. For example, the connectors 41A and 41B (41C and 41D) are arranged in one end and the connectors 41A and 41B (41C and 41D) are arranged in other end.

Figure 10:
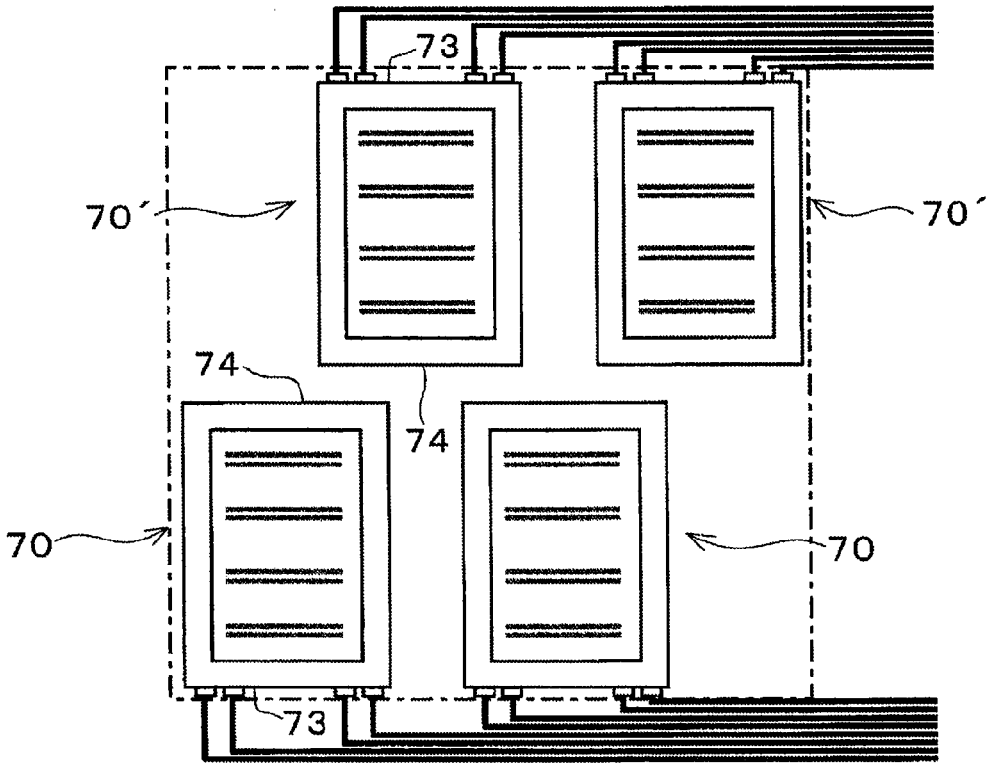
FIG. 10 is a top view showing connection of the FFCs of the line head when viewed from a bottom side.

Even when the FFCs 18 are connected to any of the connectors 41 on the two sidewalls 22*b* and 22*d* of the print heads 10, which are opposed to each other, by arranging the connectors 41 in the way, the same driving signal can be supplied. Accordingly, when the plurality of print heads 10 are arranged in two row, as shown in FIG. 10, it is not required to reverse a direction of the print heads 10 in one row, and it is possible to connect the FFCs 18 to the connectors 41 arranged on the sidewalls 22*b* (22*d*) of the outsides (outside of the line head 3) opposite the sidewalls 22*b* (22*d*) of the insides of which the print heads 10 are opposed to each other. Accordingly, it is not required to change the control of the driving signal and the print heads 10 are closely arranged in the same direction. As a result, it is possible to reduce the size of the line head 3, and thus it is easy to further reduce the size of the printer 1.

In the connectors 41 of each of the print heads 10, as shown in FIG. 4, the plurality of parallel contact points 41' are arranged in a height direction (Z direction in FIG. 4) of each of the print heads 10. That is, the connectors 41 are arranged on the sidewalls 22*b* and 22*d* so that the width direction is changed to the height direction of each of the print heads 10. According to the above-described configuration, even though types of the driving signal increases, and thus a width of the connectors 41 (the number of the contact points 41') increases, an extension of the size of the print heads 10 can be prevented laterally. It is possible to prevent the size of the line head 3 from increasing, and further it is possible to reduce the size of the printer 1 from increasing.

Next, a case where the FFCs 18 are connected to the connectors 41 in the line head 3 will be described. In this exemplary embodiment, as shown in FIG. 5, the FFCs 18 are arranged in an overlapping manner so as to be placed on the sides of the print heads 10. At this time, the direction of the cable width is changed to the height direction (where plane surfaces of the FFCs 18 face the side of the print heads 10). The connectors 41 are arranged on the sidewalls 22*b* (22*d*) so as to face the side of the print heads 10 through which the FFCs 18 pass and conductive connection portions 18' (see FIG. 8) formed in the ends of the FFCs 18 are connected to the connectors 41. When the FFCs 18 are connected in the way, the FFCs 18 connected to the connectors 41 are paralleled in the direction of the cable width so as to be neatly provided in the longitudinal direction. Further, flat portions are overlapped so as to be arranged along the sidewalls 22*b* (22*d*) on which the connectors 41 can be arranged. Accordingly, it is possible to restrain the space in which the FFCs 18 are arranged from increasing. As a result, it is possible to prevent the size of the printer 1 from increasing. Moreover, since the FFCs 18 can be arranged neatly on the sides of the print heads 10 by overlapping the flat portions, it is easy to detach and attach the FFCs 18. As a result, it is possible to further improve the assembly or maintenance.

In this exemplary embodiment, the conductive connection portions 18' of the FFCs 18 are arranged only on one portion of the ends and the contact points 41' of the connectors 41 are formed in the inner walls of one portion in a width direction of the connection ports 54. Accordingly, the conductive connection portions 18' and the contact points 41' are required to come in contact with each other in a manner in which directions thereof are matched at the time of connecting these. For example, as shown in FIG. 8(*b*), in the driving boards 28 mounted with the two connectors 41A on both the ends of one surface and mounted with two connectors 41B on both the ends of the other surface, the FFCs 18A and 18B are connected to the connectors 41A and 41B from the sidewalls 22*b* in a manner of setting the direction thereof. At this time, when the FFCs 18A and 18B are connected to the connectors 41A and 41B from the sidewall 22*d*, a direction of the conductive connection portions 18' is reversed. Accordingly, the FFCs 18A and 18B cannot be connected to the connectors 41A and 41B at this time. The FFCs 18A and 18B can be reversed in a twisting manner, but the twisted FFCs 18 occupy an unnecessary space. Accordingly, it is not possible to reduce the size of the printer 1 and it is difficult for the FFC 18 to be detached and attached. In addition, for example, it is also conceivable that a type of the connectors 41 of the sidewalls 22*d* in one side is changed and the position of the contact points 41' is changed to the opposite side. However, since two types of the connector 41 are used, the number of the elements increases, and moreover an erroneous mount process may be performed when the two types of the connectors 41 are mounted on the driving boards 28.

In the driving boards 28 according to the exemplary embodiment, as shown in FIG. 8(*a*), the connectors 41A and 41B are arranged in both the ends of the one surface and the connectors 41A and 41B are arranged in both the ends of the other surface. In addition, the connectors 41A and the connectors 41B in both the ends are arranged so as to be opposed to each other. Accordingly, when the driving boards 28 are mounted in each of the print heads 10, the sidewalls 22*b* and the sidewalls 22*d* are arranged in reverse order in terms of the direction (arrangement direction of the connectors 41: a surface direction of the sidewalls 22) of the nozzle arrays of the connectors 41A and 41B. In other words, the mutual connectors 41A (the mutual connectors 41B) are arranged so as to have a positional relationship in which they rotate by 180° in a surface direction of the nozzle formation board 37 on a rotation point O which is a center point (center point between the connectors 41B: a center point of both the ends in which the connectors 41 in the driving boards 28 are mounted) between the connectors 41A. In this way, by arranging the connectors 41, the row of the contact points 41' of the sidewall 22*b* relaying the same driving signal and the row of the contact points 41' of the connectors 41 of the sidewall 22*d* are in a reversed state. Accordingly, the FFCs 41 can be mounted to any of the connectors 41 of the sidewalls 22*b* and 22*d* without twisting the direction. As a result, it is possible to restrain the size of the printer 1 from increasing without using the unnecessary space due to the arrangement of the FFCs 18.

In this exemplary embodiment, the line head 3 in which the two print heads 10 are arranged in the direction of the nozzle array and the four print heads are arranged in two rows so as be in the zigzag shape are described as one example. However, the invention is not limited thereto in terms of the number or arrangement of the print heads. For example, the invention may be applied to the line head in which two to ten print heads may be arranged in the direction of the nozzle array and are arranged in two rows or more. In short, in the liquid ejecting apparatus such as the printer according to the exemplary embodiment, it is possible to appropriately set the direction of the nozzle array, the arrangement, or the like of the print heads so as to be suitable for usages. Further, the invention has a more advantage in that as the number of the print heads increases, the number of the ink supply tubes or the FFCs also increases.

The invention is not limited to the above-described print heads 10, but is applicable to a liquid ejecting apparatus including a liquid ejecting head mounted in a display manufacturing apparatus, an electrode manufacturing apparatus, a chip manufacturing apparatus, a micro pipette, or the like.

This application claims priority from Japanese Patent Application No. 2006-183519 filed on Oct. 18, 2006, the entire disclosure of which is expressly incorporated by reference herein.

While this invention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. There are changes that may be made without departing from the sprit and scope of the invention.

What is claimed is:

1. A liquid ejecting apparatus comprising a plurality of liquid ejecting heads, each of the liquid ejecting heads including:

a liquid introduction pressure adjusting member which is connected to a liquid passage member communicating with a liquid storing member for storing the liquid, the liquid introduction pressure adjusting member being supplied with a liquid from the liquid passage member and introducing the liquid to a side of a pressure chamber;

a nozzle array in which a plurality of nozzle holes are arrayed in a line, the nozzle holes ejecting, as liquid droplets by an operation of a pressure generating unit, the liquid introduced from the liquid introduction pressure adjusting member to the pressure chamber; and a driving board for relaying a driving signal to the pressure generating unit and which has a wire connection portion on a sidewall of the liquid ejection head, the wire connecting portion connecting to a wire member for supplying the driving signal, wherein the liquid introduction pressure adjusting member is disposed on an opposite side to a nozzle hole formation surface, wherein the liquid passage member is arranged along the nozzle array on a surface of a side of the liquid introduction pressure adjusting member opposite the nozzle hole formation surface of the liquid ejecting head, and wherein the liquid ejecting heads are arranged such that the nozzle hole formation surfaces are arranged in the same plane and the nozzle arrays are parallel to each other.

2. The liquid ejecting apparatus according to claim 1, wherein the wire connection portion is arranged on both sidewalls opposed to each other in the liquid ejecting head, and each of the wire connection portions and the driving board are electrically connected to each other such that the same driving signal is supplied to the driving board even when the wire member is connected to either the wire connection portions.

3. The liquid ejecting apparatus according to claim 1, wherein a plurality of contact points provided in the wire connection portion are arranged in a height direction of the liquid ejecting head.

4. The liquid ejecting apparatus according to claim 1, wherein the wire member is formed of a flat cable in which a plurality of conductive wires are arranged in a width direction, and the wire member positioned by changing the width direction to a height direction is connected to a lateral side of each of the liquid ejecting heads, and wherein the wire connection portion in which a plurality of contact points are provided is arranged in the sidewall so as to face the lateral side of each of the liquid ejecting heads and a conductive connection portion formed in an end of the wire member is connected to the wire connection portion.

5. The liquid ejecting apparatus according to claim 4, wherein the conductive connection portion of the flat cable is provided only on one surface of the end and a contact point of the wire connection portion is formed only on one inner wall in the width direction of a connection port of the conductive connection portion, wherein the flat cable and the wire connection portion are electrically connected to each other by matching directions of the flat cable and the wire connection portion so that the conductive connection portion and the contact point come in contact with each other, and wherein the wire connection portions to be supplied with the same driving signal are arranged so as to rotate by 180° in a direction of the nozzle hole formation surface on a center portion of the wire connection portions.

* * * * *